US006269637B1

(12) United States Patent
Motomura et al.

(10) Patent No.: US 6,269,637 B1
(45) Date of Patent: Aug. 7, 2001

(54) HYDRAULIC PRESSURE CONTROL CIRCUIT FOR A WORKING MACHINE

(75) Inventors: Hidetake Motomura; Hiroaki Tada, both of Tokyo (JP)

(73) Assignee: Shin Caterpillar Mitsubishi, Ltd., Tokyo (JP)

( * ) Notice: Subject to any disclaimer, the term of this patent is extended or adjusted under 35 U.S.C. 154(b) by 0 days.

(21) Appl. No.: 09/341,271

(22) PCT Filed: Nov. 25, 1998

(86) PCT No.: PCT/JP98/05300

§ 371 Date: Aug. 5, 1999

§ 102(e) Date: Aug. 5, 1999

(87) PCT Pub. No.: WO99/50507

PCT Pub. Date: Oct. 7, 1999

(30) Foreign Application Priority Data

Mar. 31, 1998 (JP) ..... 10-103831
Aug. 24, 1998 (JP) ..... 10-237201

(51) Int. Cl.[7] ..... F16D 31/02; F15B 11/16
(52) U.S. Cl. ..... 60/399; 60/427; 91/461
(58) Field of Search ..... 60/399, 422, 427; 91/461

(56) References Cited

U.S. PATENT DOCUMENTS 6,006,521 * 12/1999 Fuchita et al. ..... 60/422

FOREIGN PATENT DOCUMENTS

1990/2222997-A1 * 6/1989 (GB) ..... E02F/3/43
2-88823 3/1990 (JP) .
Y2-4-39879 9/1992 (JP) .
Y2-7-21655 5/1995 (JP) .

* cited by examiner

*Primary Examiner*—Edward K. Look
*Assistant Examiner*—Michael Leslie
(74) *Attorney, Agent, or Firm*—Oliff & Berridge, PLC

(57) ABSTRACT

When a working implement comes close to a cab during operation, for efficiency, the operation should continue insofar as possible yet it is essential the working implement be prevented from striking the cab. To that end, a pilot pump oil line capable of supplying pilot pressurized oil to a solenoid proportional pressure reducing valve in a state where a control member is not manipulated, is provided in a stick contraction-side pilot oil line. When the working implement enters an interference prevention area, defined around the cab, the stick is automatically moved out so that the operation can continue yet the working element avoids the interference prevention area.

14 Claims, 9 Drawing Sheets

FIG. 5

| INTERFERENCE PREVENTION AREA | STATES OF CONTROL MEMBER MANIPULATION | | | OPERATING COMMANDS | | |
|---|---|---|---|---|---|---|
| | BOOM | STICK | OFFSET | BOOM | STICK | OFFSET |
| FRONT/ SIDE-PORTION INTERFERENCE PREVENTION AREA | DOWN | — | — | DOWN | OUT | — |
| | — | IN | — | — | STOP STICK-IN | — |
| | — | — | LEFTWARD | — | — | STOP LEFTWARD OFFSET |
| | DOWN | IN | — | DOWN | OUT | — |
| | DOWN | — | LEFTWARD | DOWN | OUT | LEFTWARD |
| | — | IN | LEFTWARD | — | OUT | LEFTWARD |
| | DOWN | IN | LEFTWARD | DOWN | OUT | LEFTWARD |
| | UP | — | — | UP | OUT | — |
| | UP | IN | — | UP | OUT | — |
| | UP | — | LEFTWARD | UP | OUT | LEFTWARD |
| | UP | IN | LEFTWARD | UP | OUT | LEFTWARD |
| ROOF-PORTION INTERFERENCE PREVENTION AREA | DOWN | — | — | STOP BOOM-DOWN | — | — |
| | — | IN | — | — | STOP STICK-IN | — |
| | — | OUT | — | — | STOP STICK-OUT | — |
| | DOWN (*1) | IN | — | DOWN | OUT | — |
| | DOWN (*2) | IN | — | STOP BOOM-DOWN | STOP STICK-IN | — |
| | DOWN | OUT | — | STOP BOOM-DOWN | STOP STICK-OUT | — |

NOTE) *1 WHEN STICK ANGLE IS ANGLE OF ELEVATION
*2 WHEN STICK ANGLE IS ANGLE OF DECLINATION

HYDRAULIC PRESSURE CONTROL CIRCUIT FOR A WORKING MACHINE

BACKGROUND OF THE INVENTION

1. Field of Invention

The invention relates to a technical field of a hydraulic control circuit for working machines, such as hydraulic shovels.

2. Description of Related Art

In some working machines, such as hydraulic shovels, an offset-type working implement capable of swinging to the left and right is attached to a machine body. Generally, such working machines accompany a risk that when the working implement is moved, it may contact, or interfere, with an operator's seat portion. In such working machines, therefore, consideration must be paid to avoiding contact between the working implement and the operator's seat portion.

To that end, there has hitherto been proposed a working machine having attitude detecting means for detecting an attitude of a working implement, and a control unit for determining based on a detection signal from the attitude detecting means whether the working implement comes within a predetermined zone around the operator's seat portion. When it is determined that the working implement comes within the predetermined zone around the operator's seat portion, the control unit outputs a control command to a hydraulic circuit, for a hydraulic actuator associated with the working implement, so that the working implement is stopped.

One known example of such a related art device is shown in FIG. 9. In the example, solenoid proportional pressure reducing valves 49A, 49B, which operate in accordance with a command from a control unit, are provided between a pilot-operated control valve 46 for controlling the supply of pressurized oil to a hydraulic actuator 45, e.g., a boom cylinder, and pilot valves 48A, 48B for delivering pilot pressurized oil upon manipulation of a control member 47. When the working implement is positioned away from the operator's seat portion, the solenoid proportional pressure reducing valves 49A, 49B are opened to allow the supply of the pilot pressurized oil to the control valve 46. On the contrary, when the working implement comes close to the operator's seat portion, the solenoid proportional pressure reducing valves 49A, 49B are closed to cut off the supply of the pilot pressurized oil to the control valve 46, thereby stopping the working implement.

The above prior art however has a problem. Because the solenoid proportional pressure reducing valves are closed to stop the working implement when the working implement comes close to the operator's seat portion, as described above, the working implement is stopped during the operation and the working efficiency is reduced. The invention intends to overcome such a problem.

SUMMARY OF THE INVENTION

In view of the state of art set forth above, the invention has been made with the object of solving the above problem. In a hydraulic control circuit for a working machine, comprising a hydraulic actuator operated to move a working implement, and a pilot-operated control valve for controlling the supply of pressurized oil to the hydraulic actuator, the hydraulic control circuit includes a control valve for controlling the supply of pilot pressurized oil to the pilot-operated control valve in accordance with a command from a control unit, a pilot valve for delivering the pilot pressurized oil to the control valve in accordance with manipulation of a control member, a pilot pump oil line capable of supplying the pilot pressurized oil to the control valve from a pilot oil pressure source without passing the pilot valve, and a selector valve for supplying the pilot pressurized oil delivered from the pilot valve to the control valve when the control member is manipulated, and supplying the pilot pressurized oil from the pilot pump oil line to the control valve when the control member is not manipulated, the control unit including determining means for determining whether the working implement has entered a preset interference prevention area based on input signals from attitude detecting means for detecting an attitude of the working implement, and interference prevention control means for outputting a control command to the control valve, causing the pilot pressurized oil to be supplied to the pilot-operated control valve in the direction to move the working implement away from the interference prevention area, when the determining means determines that the working implement has entered the preset interference prevention area.

In the above hydraulic control circuit, the hydraulic actuator for moving the working implement comprises a boom up-and-down moving cylinder for vertically swinging an offset type boom which is swingable in the up-and-down and left-and-right directions, a boom left-and-right moving cylinder for swinging the boom to the left and right, and a stick cylinder for swinging a stick back and forth which is supported to a fore end of the boom to be swingable in the back-and-forth direction; the control valve, the pilot valve, the pilot pump oil line and the selector valve are provided in an oil line for supplying the pilot pressurized oil to the pilot-operated control valve for the stick cylinder in the direction to move the stick away from the interference prevention area; and the control valve and the pilot valve are provided in each oil line for supplying the pilot pressurized oil to each of the pilot-operated control valves for the boom up-and-down moving cylinder, the boom left-and-right moving cylinder, and the stick cylinder in the direction to move the boom or the stick closer toward the interference prevention area.

Also, according to a second aspect of the invention, in a hydraulic control circuit for a working machine comprising first and second hydraulic actuators for operating a working implement, and first and second pilot-operated control valves for respectively controlling supply of pressurized oil to the hydraulic actuators, the hydraulic control circuit includes interference prevention control means for preventing the working implement from entering a interference prevention area set in advance to avoid interference between a body of the working machine and the working implement; and the interference prevention control means includes a mechanism for operating the first hydraulic actuator in the direction away from the interference prevention area, thereby continuing operation of the second hydraulic actuator while the working implement is prevented from entering the interference prevention area, when it is determined at least in a state of the second hydraulic actuator being operated that the working implement has reached the interference prevention area, the mechanism including valve means for switching over the circuit such that pilot pressurized oil for operating the second hydraulic actuator is also supplied to a pilot oil line for operating the first hydraulic actuator in the direction away from the interference prevention area.

In the above hydraulic control circuit, the hydraulic control circuit may include first and second approaching-side pilot oil lines for supplying the pilot pressurized oil respectively to the first and second pilot-operated control valves in the direction of moving the working implement to approach the interference prevention area, first and second away-side pilot oil lines for supplying the pilot pressurized oil respectively to the first and second pilot-operated control valves in the direction of moving the working implement away from the interference prevention area, and first and second approaching- and away-side pilot valves for outputting the pilot pressurized oil respectively to the first and second approaching- and away-side pilot oil lines in accordance with manipulation of first and second control members, and a control valve for opening and closing one of the pilot oil lines in accordance with a command from the interference prevention control means may be provided at least in the first approaching-side pilot line.

In the above hydraulic control circuit, when the second hydraulic actuator is provided as plurality of facilitators, a second pilot-operated control valve, a second approaching- and away-side pilot oil lines, a second approaching- and away-side pilot valves may be provided for each of the hydraulic actuators, and the pilot pressurized oil delivered from the second approaching-side pilot valve may be supplied to the valve means after being joined with other pilot pressurized oil through a shuttle valve for selecting the pilot pressurized oil on the higher pressure side.

Further, the valve means may comprise a selector valve for switching over the circuit such that when the pilot pressurized oil is delivered from the first away-side pilot valve, the delivered pilot pressurized oil is supplied to the first away-side pilot oil line, and when the pilot pressurized oil is not delivered from the first away-side pilot valve, the pilot pressurized oil delivered from the second approaching-side pilot valve is supplied to the first away-side pilot oil line, and a control valve for opening and closing the first approaching-side pilot oil line in accordance with a command from the interference prevention control means.

Moreover, the valve means may comprise a control valve for outputting the pilot pressurized oil delivered from the second approaching-side pilot valve in accordance with a command from the interference prevention control means, and a shuttle valve for selecting one on the higher pressure side of the pilot pressurized oil delivered from the control valve and the pilot pressurized oil delivered from the first away-side pilot valve and supplying the selected pilot pressurized oil to the first away-side pilot oil line.

In the above features, the working machine may be a hydraulic shovel including, as the second hydraulic actuator, a boom up-and-down moving cylinder for vertically swinging an offset type boom which is swingable in the up-and-down and left-and-right directions, and an offset cylinder for swinging the boom to the left and right, and including, as the first hydraulic actuator, a stick cylinder for swinging a stick back and forth which is supported to a fore end of the boom to be swingable in the back-and-forth direction.

BRIEF DESCRIPTION OF THE DRAWINGS

FIG. 5 is a table showing control commands for the interference prevention control;

DETAILED DESCRIPTION OF PREFERRED EMBODIMENTS

Figure 1:
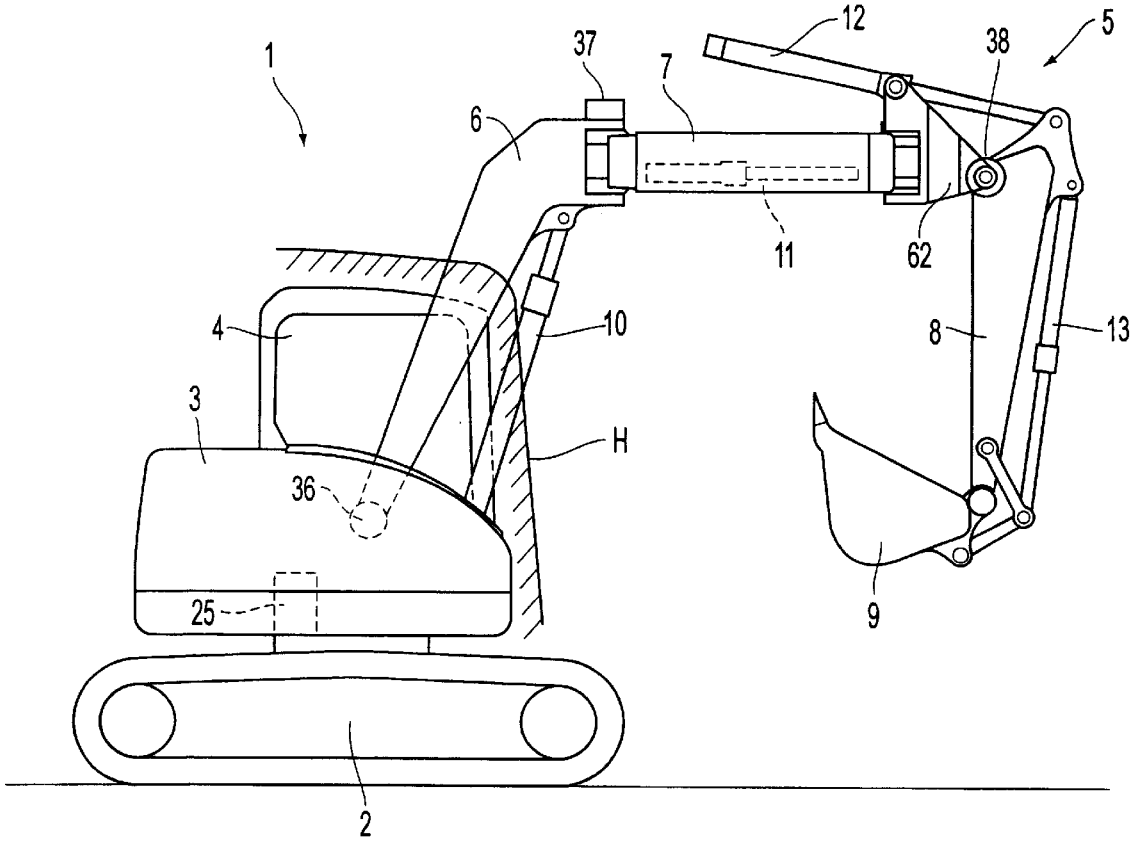
FIG. 1 is a side view of a hydraulic shovel.
Figure 2:
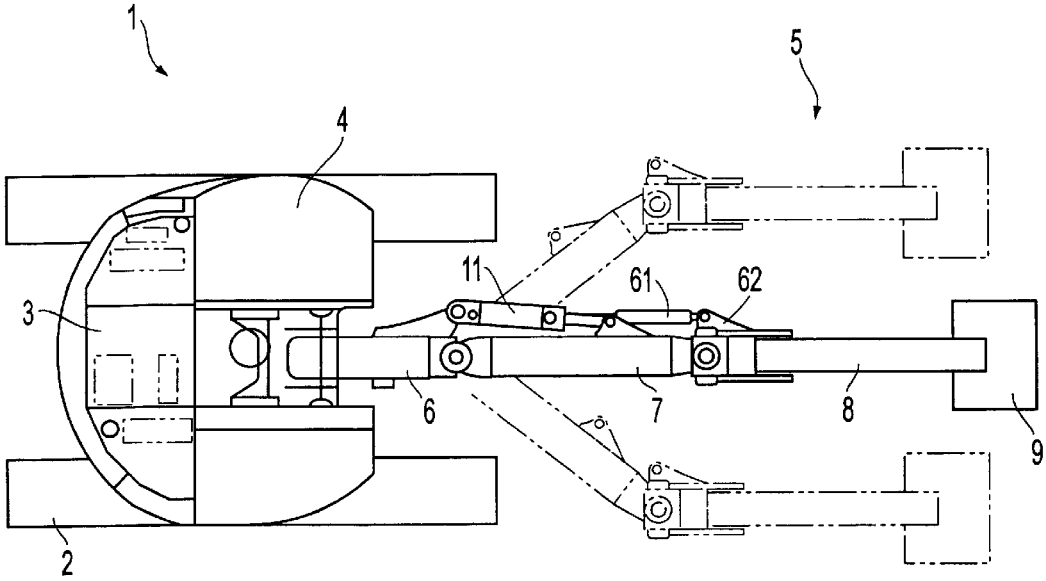
FIG. 2 is a plan view of a hydraulic shovel, showing a state where a front boom is swung to the left and right.

A first embodiment of the invention will be first described with reference to FIGS. 1 to 6. In FIGS. 1 and 2, numeral 1 denotes an offset type hydraulic shovel having a similar basic structure as the conventional hydraulic shovel. The hydraulic shovel 1 is made up of various components, such as a traveling undercarriage 2, an upper swiveling body 3, a cab 4, and a working implement 5. The working implement 5 comprises a rear boom 6 supported at its base end to the upper swiveling body 3 to be swingable vertically, a front boom 7 supported to a fore end of the rear boom 6 to be swingable to the left and right, a stick 8 supported to a fore end of the front boom 7 to be swingable in the left-and-right and the back-and-forth directions, and a bucket 9 supported to a fore end of the stick 8 to be swingable back and forth. For swinging those members, the working implement 5 further comprises a boom cylinder (corresponding to a boom up-and-down moving cylinder in the invention) 10, an offset cylinder (corresponding to a boom left-and-right moving cylinder in the invention) 11, a stick cylinder 12, and a bucket cylinder 13. In this embodiment, the cab 4 is provided on the left side of the upper swiveling body 3.

The rear boom 6 is constructed to move down when the boom cylinder 10 is contracted, and to move up when the boom cylinder 10 is extended. Also, the front boom 7 is constructed to move to the left, i.e., in the direction toward the cab 4, when the offset cylinder 11 is contracted, and to move to the right when the offset cylinder 11 is extended. Furthermore, the stick 8 is constructed to swing (stick-in) toward the machine body when the stick cylinder 12 is extended, and to swing (stick-out) away from the machine body and move up when the stick cylinder 12 is contracted.

Figure 3:
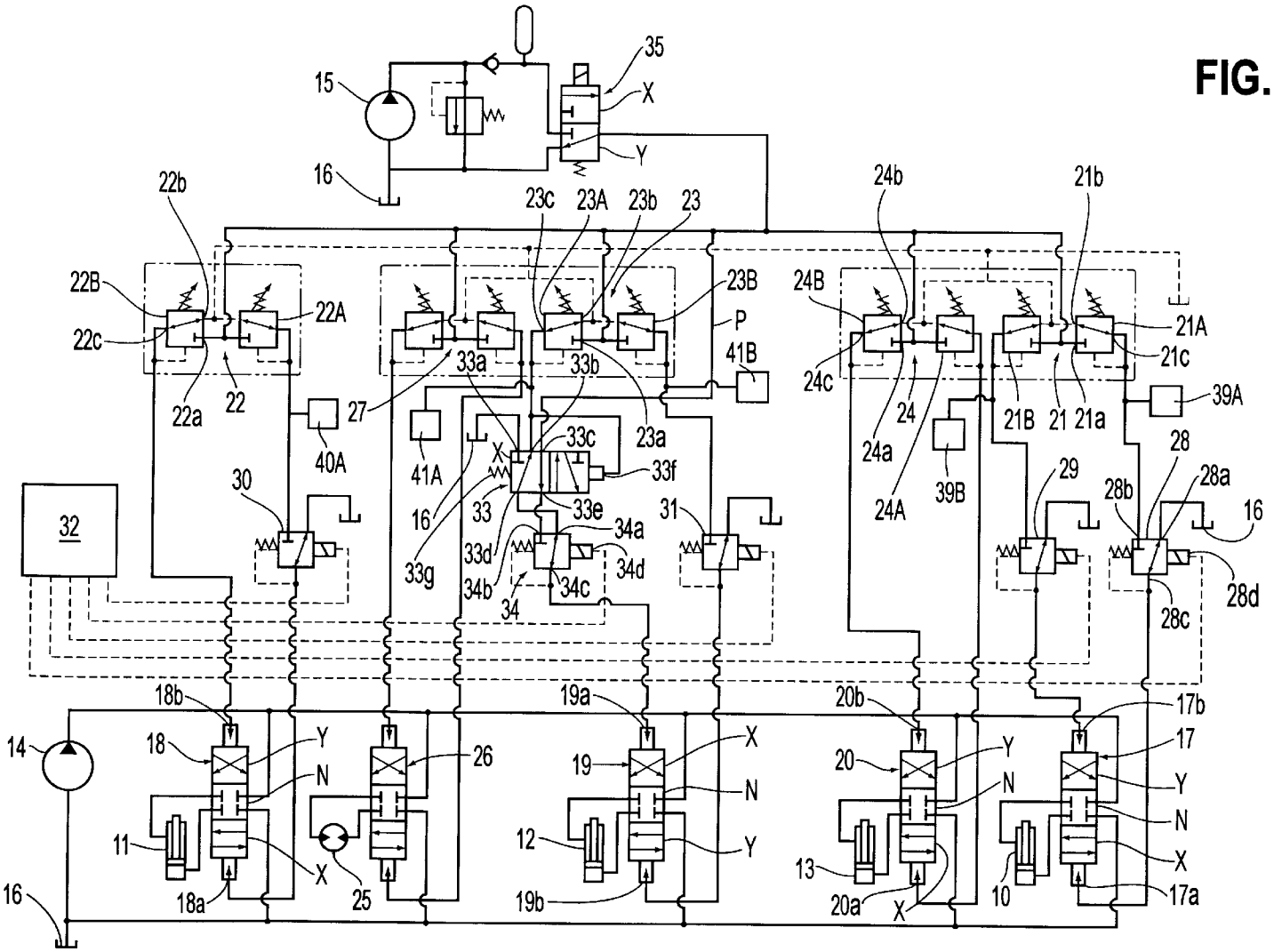
FIG. 3 is a hydraulic control circuit diagram for a hydraulic actuator according to a first embodiment.

Control of the supply of pressurized oil to the cylinders 10–13 will be described with reference to a hydraulic control circuit diagram shown in FIG. 3. In FIG. 3, numeral 14 denotes a main pump, 15 denotes a pilot pump, 16 denotes an oil tank, and 17–20 denote control valves for the boom, the offset, the stick and the bucket, respectively. The control valves 17–20 comprise pilot-operated 3-position selector valves provided with contraction-side pilot ports 17*a*–20*a* and extension-side pilot ports 17*b*–20*b*, respectively.

When no pilot pressurized oil is supplied to any of the pilot ports 17*a*–20*a* and 17*b*–20*b*, the control valves 17–20 are held in neutral positions N where the supply of the pressurized oil to the corresponding cylinders 10–13 is stopped. When the pilot pressurized oil is supplied to the contraction-side pilot ports 17*a*–20*a*, the control valves 17–20 are shifted to contraction-side positions X where the pressurized oil from the main pump 14 is supplied to contraction-side oil chambers of the cylinders 10–13. Also, when the pilot pressurized oil is supplied to the extension-side pilot ports 17*b*–20*b*, the control valves 17–20 are shifted to extension-side positions Y where the pressurized oil from the main pump 14 is supplied to extension-side oil chambers of the cylinders 10–13.

Numerals 21–24 denote respectively boom, offset, stick and bucket pilot valves for supplying pilot pressurized oil to the pilot ports 17*a*–20*a*, 17*b*–20*b* of the control valves 17–20 in accordance with the manipulation of the control members (not shown). The pilot valves 21–24 comprise contraction-side pilot valves 21A–24A and extension-side pilot valves 21B–24B, respectively.

The pilot valves 21–24 are structured as follows. When the corresponding control members are in neutral positions (i.e., they are not manipulated), pump ports 21*a*–24*a* connected to the pilot pump 15 are closed, and tank ports 21*b*–24*b* connected to the oil tank 16 are in communication with output ports 21*c*–24*c*. When the control members are manipulated to the contraction side and the extension side, the output ports 21*c*–24*c* of the pilot valves 21A–24A or 21B–24B, on the side to which the control members are manipulated, are in communication with the pump ports 21*a*–24*a*, whereupon the pilot pressurized oil is delivered through the output ports 21*c*–24*c* at pressures corresponding to the amount by which the control members are manipulated.

Further, in FIG. 3, numerals 25, 26, 27 denote respectively a swivel motor, a swivel control valve, and a swivel pilot valve which cooperatively turn the upper swiveling body 3.

The solenoid proportional pressure reducing valves 28, 29, 30, 31 for the boom contraction side, the boom extension side, the offset contraction side and the stick extension side are provided respectively in a boom contraction-side pilot oil line connecting the boom contraction-side pilot valve 21A and the boom control valve contraction-side pilot port 17*a*, a boom extension-side pilot oil line connecting the boom extension-side pilot valve 21B and the boom control valve extension-side pilot port 17*b*, in an offset contraction-side pilot oil line connecting the offset contraction-side pilot valve 22A and the offset control valve contraction-side pilot port 18*a*, and a stick extension-side pilot oil line connecting the stick extension-side pilot valve 23B and the stick control valve extension-side pilot port 19*b*. Because each of the solenoid proportional pressure reducing valves 28, 29, 30, 31 have a similar structure, the solenoid proportional pressure reducing valve 28 on the boom extension side will, by way of example, be described. The solenoid proportional pressure reducing valve 28 has first to third ports 28*a*, 28*b*, 28*c* and a solenoid 28*d*. The first port 28*a* is connected to the oil tank 16, the second port 28*b* is connected to the output port 21*c* of the boom contraction-side pilot valve 21A, and the third port 28*c* is connected to the contraction-side pilot port 17*a* of the boom control valve 17.

When the solenoid 28*d* is not excited, the solenoid proportional pressure reducing valve 28 opens a valve passage communicating the first port 28*a* and the third port 28*c*, and closes the second port 28*b*, thereby draining the oil from the contraction-side pilot port 17*a* to the oil tank 16. When the solenoid 28*d* is excited in accordance with an operating command from a control unit 32 (described later), an output valve passage communicating the second port 28*b* and the third port 28*c* is opened. Upon the above output valve passage being opened, the pilot pressurized oil from the pilot valve output port 21*c* is delivered to the control valve contraction-side pilot port 17*a*. The output pressure is increased and decreased in accordance with a control command outputted to an excitation circuit of the solenoid 28*d* from the control unit 32.

On the other hand, a selector valve 33 and a solenoid proportional pressure reducing valve 34 on the stick contraction side are provided in a stick contraction-side pilot oil line connecting the stick contraction-side pilot valve 23A and the stick control valve contraction-side pilot port 19*a*.

A selector valve 33 is a 5-port, 2-position selector valve having a first port 33*a* connected to the oil tank 16, a second port 33*b* connected to an output port 23*c* of the stick contraction-side pilot valve 23A, a third port 33*c* connected to a pilot pump oil line P, a fourth port 33*d* connected to a first port 34*a* of the solenoid proportional pressure reducing valve 34 on the stick contraction side, and a fifth port 33*e* connected to a second port 34*b* of the solenoid proportional pressure reducing valve 34 on the stick contraction side. Here, the pilot pump oil line P is an oil line extending from a point upstream of the stick pilot valve 23 to the selector valve 33. Through the pilot pump oil line P, the pressurized oil from the pilot pump 15 is supplied to the selector valve 33 while bypassing the stick pilot valve 23.

The selector valve 33 further has a pilot port 33*f*. The pilot port 33*f* is connected to a pilot oil line connecting the stick contraction-side pilot valve output port 23*c* and the selector valve second port 33*b*. When the pilot pressurized oil is delivered from the stick contraction-side pilot valve 23A, the pilot pressurized oil is supplied to the pilot port 33*f* as well.

In a state where the pilot pressurized oil is not supplied to the pilot port 33*f*, the selector valve 33 is in a first position X at which the first port 33*a* is closed by an urging force of a spring 33*g*, a valve passage extending from the third port 33*c* to the fifth port 33*e* is opened, and a valve passage extending from the fourth port 33*d* to the second port 33*b* is opened. Therefore, the pilot pressurized oil from the pilot pump line P can be supplied to the solenoid proportional pressure-reducing-valve second port 34*b*, and the oil from the solenoid proportional pressure-reducing-valve first port 34*a* can be drained to the oil tank 16 through the pilot valve 23A.

On the contrary, when the pilot pressurized oil is supplied to the pilot port 33*f*, the selector valve 33 is shifted to a second position Y at which the third port 33*c* is closed, a valve passage extending from the second port 33*b* to the fifth port 33*e* is opened, and a valve passage extending from the fourth port 33*d* to the first port 33*a* is opened. Therefore, the pilot pressurized oil from the pilot valve output port 23*c* can be supplied to the solenoid proportional pressure-reducing-valve second port 34*b*, and the oil from the solenoid proportional pressure-reducing-valve first port 34*a* can be drained to the oil tank 16.

Also, the solenoid proportional pressure reducing valve 34 on the stick contraction side has a similar structure to that of the solenoid proportional pressure reducing valves 28, 29, 30, 31 described above, and operates to increase and decrease the output pressure in accordance with a control command from the control unit 32. The solenoid proportional pressure reducing valve 34 on the stick contraction side has the first port 34*a* connected to the fourth port 33*d* of the selector valve 33, the second port 34*b* connected to the selector valve fifth port 33*e*, and a third port 34*c* connected to the contraction-side pilot port 19*a* of the stick control valve 19, respectively.

In a state where a solenoid 34*d* is not excited, the solenoid proportional pressure reducing valve 34 on the stick contraction side opens a valve passage communicating the first port 34*a* and the third port 34*c*, and closes the second port 34*b*, thereby draining the oil from the contraction-side pilot port 19*a* to the oil tank 16. When the solenoid 34*d* is excited in accordance with an operating command from the control unit 32, an output valve passage communicating the second port 34*b* and the third port 34*c* is opened. Upon the above output valve passage being opened, the pilot pressurized oil from the pilot pump oil line P having passed the selector valve 33 in the first position X or the pilot pressurized oil from the pilot valve 23A having passed the selector valve 33 in the second position Y is delivered to the control valve contraction-side pilot port 19*a*.

Further, a locking solenoid valve 35 is disposed on the primary (upstream) side of the pump ports 21*a*–24*a* of the pilot valves 21–24 and the third port 33*c* of the selector valve 33. Upon a lock control member (not shown) being manipulated by an operator, the locking solenoid valve 35 is shifted between an unlock position X at which the pilot pressurized oil from the pilot pump 15 is delivered to the pilot valves 21–24 and the selector valve 33, and a lock position Y at which the pilot pressurized oil is not delivered.

The control unit 32 comprises a microcomputer that receives signals from a boom angle sensor 36 for detecting a relative angle of the rear boom 6 to the upper swiveling body 3, an offset angle sensor 37 for detecting a relative angle of the front boom 7 to the rear boom 6, a stick angle sensor 38 for detecting a relative angle of the stick 8 to the front boom 7, a pressure sensor 39A on the boom contraction side for detecting that the pilot pressurized oil is delivered from the boom contraction-side pilot valve 21A, as well as other pressure sensors 39B, 40A, 41A, 41B on the boom extension side, the offset contraction side, the stick contraction side, and the stick extension side for respectively detecting that the pilot pressurized oil is delivered from the pilot valves 21B, 22A, 23A, 23B on the boom extension side, the offset contraction side, the stick contraction side, and the stick extension side. Based on the input signals, the control unit 32 outputs control commands to the solenoid proportional pressure reducing valves 28, 29, 30, 34, 31 on the boom contraction side, the boom extension side, the offset contraction side, the stick contraction side, and the stick extension side, etc.

Incidentally, solenoid proportional pressure reducing valves, which are operated in accordance with commands from the control unit 32, are not provided in a pilot oil line connecting the offset extension-side pilot valve 22B and the offset control valve extension-side pilot port 18*b*, in an bucket contraction-side pilot oil line connecting the bucket contraction-side pilot valve 24A and the bucket control valve contraction-side pilot port 20*a*, and a bucket extension-side pilot oil line connecting the bucket extension-side pilot valve 24B and the bucket control valve extension-side pilot port 20*b*. Upon the control members being manipulated, therefore, the pilot pressurized oil delivered from the pilot valves 22B, 24A, 24B is directly supplied to the pilot ports 18*b*, 20*a*, 20*b*. In other words, the operations of rightward offset and the bucket 9 are always performed as per the manipulations of the control members without undergoing a later-described interference prevention control made by the control unit 32.

Figure 4:
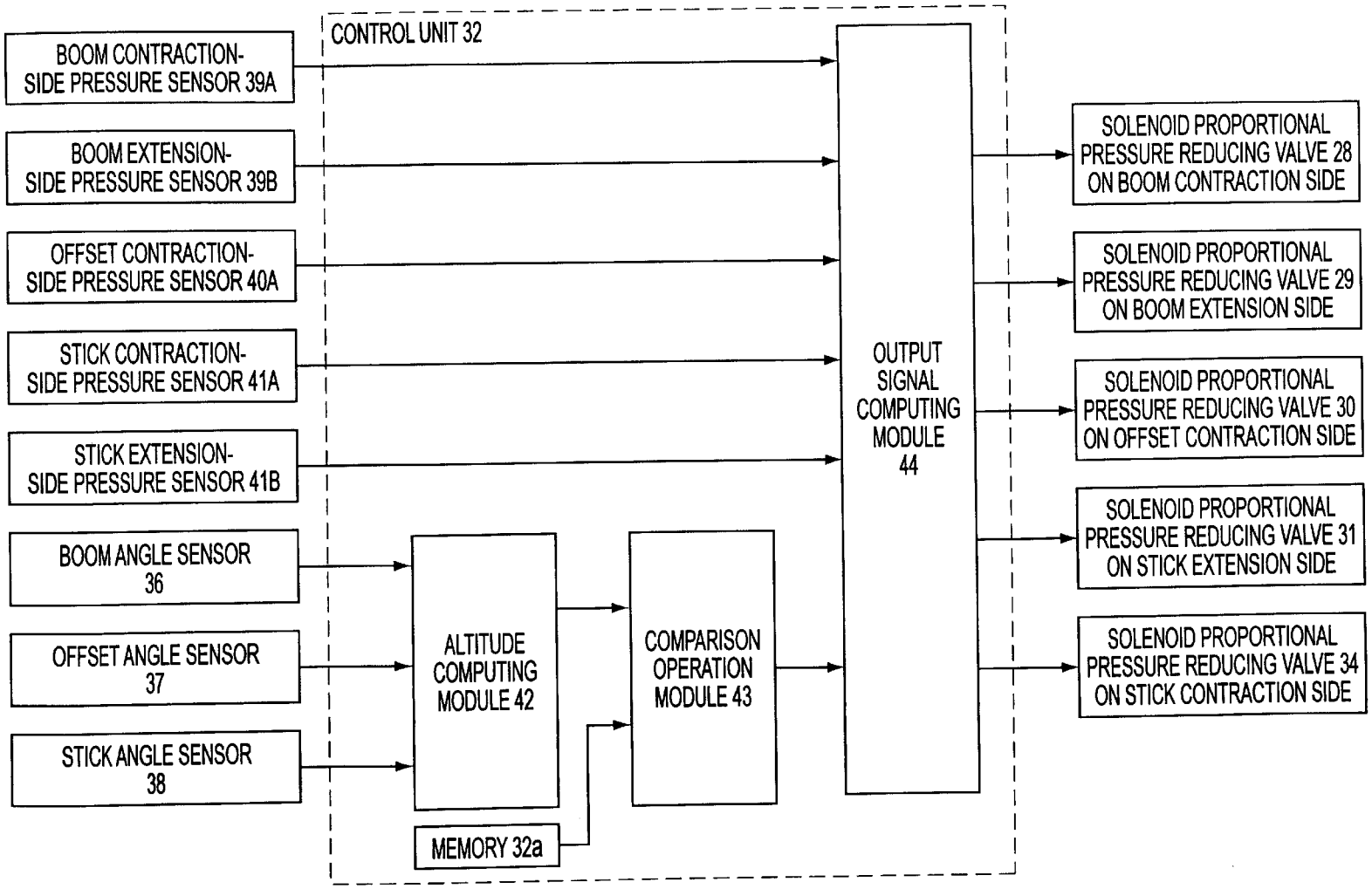
FIG. 4 is a block diagram showing control procedures for interference prevention control.

Next, the interference prevention control made by the control unit 32 will be described with reference to a block diagram shown in FIG. 4. The control unit 32 first computes an attitude (position) of the working implement 5 by an attitude computing module 42 based on the detection signals from the boom angle sensor 36, the offset angle sensor 37, and the stick angle sensor 38. A memory 32*a* in the control unit 32 stores an interference prevention area (e.g., a zone within 300 mm from the cab 4) H set to prevent the working implement 5 from entering the area and coming close to the cab 4. The control unit 32 then executes comparison operation using a comparison operation module 43 for the attitude of the working implement 5 computed by the attitude computing module 42 and the interference prevention area H stored in the memory 32*a*, and outputs an operation result to an output signal computing module 44.

The signals from the pressure sensors 39A, 39B, 40A, 41A, 41B on the boom contraction side, the boom extension side, the offset contraction side, the stick contraction side, and the stick extension side, respectively, are also inputted to the output signal computing module 44.

Based on the input signals from the comparison operation module 43 and the pressure sensors 39A, 39B, 40A, 41A, 41B, the output signal computing module 44 outputs command signals to solenoid excitation circuits of the solenoid proportional pressure reducing valves 28, 29, 30, 34, 31 on the boom contraction side, the boom extension side, the offset contraction side, the stick contraction side, and the stick extension side.

More specifically, when the comparison operation module 43 provides an operation result indicating the working implement 5 is away from the interference prevention area H by a distance not smaller than a certain range set in advance, the output signal computing module 44 outputs solenoid excitation commands to the solenoid proportional pressure reducing valves 28, 29, 30, 34, 31 in the pilot oil lines where delivery of the pilot pressurized oil is detected by the pressure sensors 39A, 39B, 40A, 41A, 41B, causing the output valve passages to be fully opened.

Therefore, when the pilot pressurized oil is delivered from the pilot valves 21A, 21B, 22A, 23B on the boom contraction side, the boom extension side, the offset contraction side, and the stick extension side upon manipulation of the control members, the delivered pilot pressurized oil is supplied as it is to the control valve pilot ports 17*a*, 17*b*, 18*a*, 19*b* via the solenoid proportional pressure reducing valves 28, 29, 30, 31 which are fully opened.

Also, while the selector valve 33 is provided in the stick contraction-side pilot oil line, the selector valve 33 is shifted to the second position Y for supplying the pilot pressurized oil from the pilot valve 23A to the solenoid proportional pressure reducing valve 34, as described above, in the state where the pilot pressurized oil is delivered from the stick contraction-side pilot valve 23A upon manipulation of the control member. Therefore, when the pilot pressurized oil is delivered from the stick contraction-side pilot valve 23A upon manipulation of the control member, the delivered pilot pressurized oil is supplied to the control valve pilot port 19*a* via the selector valve 33 in the second position Y and the solenoid proportional pressure reducing valve 33 which is fully opened.

Thus, when the working implement 5 is away from the interference prevention area H by the predetermined distance or more, the working implement 5 is operated as per the manipulation of the control member.

On the contrary, when the comparison operation module 43 provides as an operation result that the working implement 5 is coming or has come into the certain range set in advance with respect to the interference prevention area H, the output signal computing module 44 outputs solenoid excitation commands to the solenoid proportional pressure reducing valves 28, 29, 30, 34, 31 in the pilot oil lines where delivery of the pilot pressurized oil is detected by the pressure sensors 39A, 39B, 40A, 41A, 41B, causing the output valve passages to be opened. In this case, the opening degrees of the output valve passages of the solenoid proportional pressure reducing valves 28, 29, 30, 34, 31 are adjusted so that the output pressures of the solenoid proportional pressure reducing valves 28, 29, 30, 34, 31 become smaller as the working implement 5 comes closer to the interference prevention area H.

Therefore, when the pilot pressurized oil is delivered from the pilot valves 21A, 21B, 22A, 23A, 23B on the boom contraction side, the boom extension side, the offset contraction side, the stick contraction side, and the stick extension side upon manipulation of the control members, the delivered pilot pressurized oil is supplied to the control valve pilot ports 17*a*, 17*b*, 18*a*, 19*a*, 19*b* while being reduced in pressure by the solenoid proportional pressure reducing valves 28, 29, 30, 34, 31.

Thus, when the working implement 5 approaches the interference prevention area H within the predetermined distance, the operations of boom-down, boom-up, stick-out, stick-in, and leftward offset are performed at slowed down speeds.

Then, when the comparison operation module 43 provides as an operation result the working implement 5 has reached an outer boundary line of the interference prevention area H, the output signal computing module 44 outputs control commands to the solenoid proportional pressure reducing valves 28, 29, 30, 31, 34 based on a command control table shown in FIG. 5. In this embodiment, two areas, i.e., an interference prevention area for a cab front/side portion (a front portion and a right side portion of the cab) and an interference prevention area for a cab roof portion, are each set as the interference prevention area H. In these areas, the control is executed separately.

FIG. 5 shows the relationship between the states of control member manipulation and operating commands issued to the working implement 5. In this respect, the states of the control member manipulations for the boom-down, boom-up, stick-out, stick-in, and leftward-offset operations are determined in accordance with inputting of the detection signals from the pressure sensors 39A, 39B, 41A, 41B, 40A on the boom contraction side, the boom extension side, the stick contraction side, the stick extension side, and the offset contraction side.

As to the operating commands for the boom-down, boom-up, stick-out, and leftward-offset operations, solenoid excitation commands are outputted to the solenoid proportional pressure reducing valves 28, 29, 34, 30 on the boom contraction side, the boom extension side, the stick contraction side, and the offset contraction side, causing the output valve passages to be opened. Further, as to the operating commands to stop the boom-down, boom-up, stick-in, stick-out, and leftward-offset operations, solenoid non-excitation commands are outputted to the solenoid proportional pressure reducing valves 28, 29, 31, 34, 30 on the boom contraction side, the boom extension side, the stick extension side, the stick contraction side, and the offset contraction side, causing the output valve passages to be closed.

Here, the operating commands for the boom-down, boom-up, and leftward-offset operations are outputted in states where the boom-down, boom-up, and leftward-offset manipulations are performed. Accordingly, when the output valve passages of the solenoid proportional pressure reducing valves 28, 29, 30 are opened, the pilot pressurized oil delivered from the pilot valves 21A, 21B, 22A is supplied to the control valve pilot ports 17*a*, 17*b*, 18*a*. On the other hand, the operating command for the stick-out operation is outputted in a state where the stick-out manipulation is not performed, and hence the pilot pressurized oil is not delivered from the pilot valve 23A. In the state where the pilot pressurized oil is not delivered from the pilot valve 23A, however, the selector valve 33 provided in the stick contraction-side pilot oil line is in the first position X, as described above. Accordingly, the pilot pressurized oil from the pilot pump oil line P is supplied to the control valve pilot port 19*a* via the selector valve 33 in the first position X and the solenoid proportional pressure reducing valve 34.

A description will be first made on the control to be executed when the working implement 5 has reached the outer boundary line of the interference prevention area H given by the front/side-portion interference prevention area. When the boom-down manipulation is solely performed, the operating commands for the boom-down and stick-out operations are outputted. As a result, the boom-down operation can be continued while the stick 8 is moved out so as to avoid the working implement 5 from entering the interference prevention area H. In this case, the working implement 5 is moved down substantially along the outer boundary line of the interference prevention area H.

When the stick-in manipulation is solely performed, the operating command to stop the stick-in operation is outputted. Also, when the leftward-offset manipulation is solely performed, the operating command to stop the leftward offset operation is outputted.

When the boom-down and stick-in manipulations are performed in a combined manner, the operating commands for the boom-down and stick-out manipulations are outputted. Also, when the boom-down and leftward-offset manipulations are performed in a combined manner, the operating commands for the boom-down, stick-out and leftward-offset operations are outputted. Further, when the stick-in and leftward-offset manipulations are performed in a combined manner, the operating commands for the stick-out and leftward-offset operations are outputted. Moreover, when the boom-down, stick-in and leftward-offset manipulations are performed in a combined manner, the operating commands for the boom-down, stick-out and leftward-offset operations are outputted. As a result, the boom-down and leftward-offset operations can be continued while the stick 8 is moved out so as to avoid the working implement 5 from entering the interference prevention area H. In this case, the working implement 5 is moved substantially along the outer boundary line of the interference prevention area H.

When the boom-up manipulation is solely performed, the operating commands for the boom-up and stick-out operations are outputted. As a result, the boom-up operation can be continued while the stick 8 is moved out so as to avoid the working implement 5 from entering the interference prevention area H. In this case, the working implement 5 is moved substantially along the outer boundary line of the interference prevention area H.

When the boom-up and stick-in manipulations are performed in a combined manner, the operating commands for the boom-up and stick-out operations are outputted. Also, when the boom-up and leftward-offset manipulations are performed in a combined manner, the operating commands for the boom-up, stick-out and leftward-offset operations are outputted. Further, when the boom-up, stick-in and leftward-offset manipulations are performed in a combined manner, the operating commands for the boom-up, stick-out and leftward-offset operations are outputted. As a result, the boom-up and leftward-offset operations can be continued while the stick 8 is moved out so as to avoid the working implement 5 from entering the interference prevention area H. In this case, the working implement 5 is moved substantially along the outer boundary line of the interference prevention area H.

In the control relating to the front/side-portion interference prevention area, when the stick-out manipulation is performed solely or in combination with any of the above-mentioned manipulations (it is a matter of course that the stick-out manipulation and the stick-in manipulation are never performed at the same time), the operating command for the stick-out operation is outputted solely or in combination with any of the above-mentioned operating commands.

Next, a description will be made of the control to be executed when the working implement 5 has reached the outer boundary line of the interference prevention area H given by the roof-portion interference prevention area. When the boom-down manipulation is solely performed, the operating command to stop the boom-down operation is outputted. When the stick-in manipulation is solely performed, the operating command to stop the stick-in operation is outputted. When the stick-out manipulation is solely performed, the operating command to stop the stick-out operation is outputted.

As to the operating command outputted when the boom-down manipulation is solely performed, the setting may be changed such that the operating commands for the boom-down and stick-out operations are outputted on condition that the angle of the stick 8 is an angle of elevation, as with when the boom-down and stick-in manipulations are performed in a combined manner as described later. In such a case, the boom-down operation can be continued while the stick 8 is moved out so as to avoid the working implement 5 from entering the interference prevention area H.

Figure 6B:
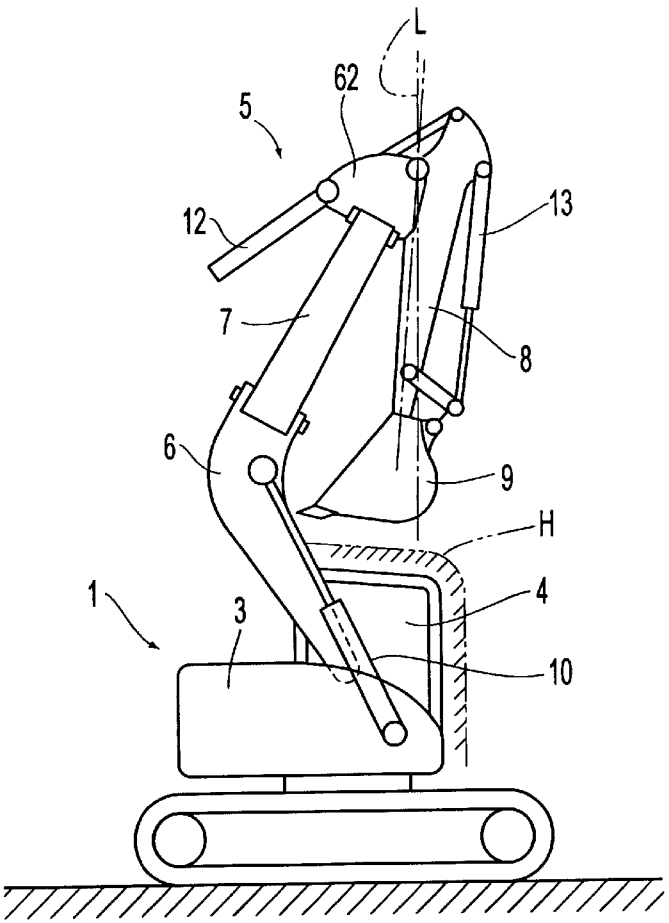
FIGS. 6(A) and (B) show respectively the case where the stick angle is an angle of elevation and the case where the stick angle is an angle of declination.
Figure 6A:
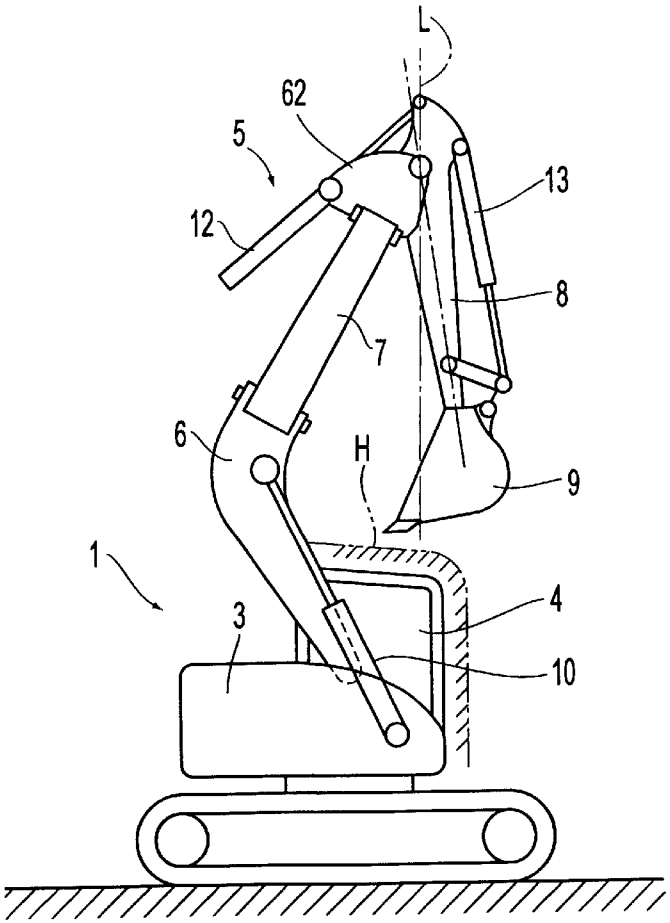

When the boom-down and stick-in manipulations are performed in a combined manner, the operating commands for the boom-down and stick-out operations or the operating commands to stop the boom-down and stick-in operations are outputted depending on the attitude of the stick 8. Specifically, when the angle of the stick 8 is an angle of elevation with respect to a vertical line L passing the pivotal fulcrum of the stick 8 as shown in FIG. 6(A), the operating commands for the boom-down and stick-out operations are outputted. As a result, the boom-down operation can be continued while the stick 8 is moved out so as to avoid the working implement 5 from entering the interference prevention area H. In this case, the working implement 5 is moved substantially along the outer boundary line of the interference prevention area H. Also, when the angle of the stick 8 is an angle of declination with respect to the vertical line L passing the pivotal fulcrum of the stick 8 as shown in FIG. 6(B), the operating commands to stop the boom-down and stick-in operations are outputted.

When the boom-down and stick-out manipulations are performed in a combined manner, the operating commands to stop the boom-down and stick-out operations are outputted.

Furthermore, in this control regarding the roof portion interference prevention area, when the boom-up manipulation is performed, the operating command for the boom-up operation is outputted, and when the leftward-offset manipulation is performed, the operating command for the leftward-offset operation is outputted. However, when the boom-up and leftward-offset manipulations are performed in combination with any of the above-mentioned manipulations (it is a matter of course that the boom-up manipulation and the boom-down manipulation are never performed at the same time), the operating commands for the boom-up and leftward-offset operations are outputted in combination with any of the above-mentioned operations.

Additionally, in the control regarding any of the front/side-portion interference prevention areas and the roof-portion interference prevention area, the operations of rightward offset and the bucket 9 are performed as per the manipulations of the control members because those operations are not subject to the interference prevention control as described above.

With the hydraulic control circuit thus structured, the working implement 5 is controlled as described above. Specifically, when the working implement 5 is away from the interference prevention area H by the predetermined distance or more, the working implement 5 is operated as per the manipulation of the control member. However, when the working implement 5 approaches the interference prevention area H within the predetermined distance, the working implement 5 is automatically slowed down. Upon reaching the interference prevention area H, depending on the states of control member manipulation and the attitude of the working implement 5, the working implement 5 is automatically stopped, or the stick 8 is automatically moved out so that the up-and-down and leftward-offset operations of the boom 3 can be continued while avoiding the working implement 5 from entering the interference prevention area H.

As a result, when the working implement 5 reaches the interference prevention area H during the boom-down manipulation, for example, the stick 8 is automatically moved out and the operation of moving the boom 6 down can be continued while avoiding the interference prevention area H. Thus, the operation is no longer suspended as it was in the prior art. Therefore, working efficiency is improved.

In addition, since the operation can be continued while avoiding the interference prevention area H just by automatically moving the stick 8 out, a circuit for automatically contracting a cylinder is required to be built in only the circuit for the stick cylinder 12 among the hydraulic actuators provided on the working implement 5. This contributes to simplifying the circuit and holding down any cost increases.

Such a circuit for automatically contracting a cylinder, which is to be built in the circuit for the stick cylinder 12, is built in the stick contraction-side pilot oil line. In this regard, one of the pilot pressurized oil delivered from the pilot valve 23A and the pilot pressurized oil supplied through the pilot pump oil line P is selected by the selector valve 33, and the selected pilot pressurized oil is supplied to the solenoid proportional pressure reducing valve 34 which is operated in accordance with a command from the control unit 32. It is therefore only required to provide the selector valve 33 and the pilot pump oil line P in the conventional circuit for automatically stopping the cylinder with no need of adding an expensive solenoid proportional pressure reducing valve. This further contributes to holding down any increase in costs.

In the above first embodiment, the selector valve 33 is constructed to shift from the first position X to the second position Y upon the pilot pressurized oil being supplied to the pilot port 33*f*. However, the selector valve may comprise a solenoid valve shifting from a first position to a second position in accordance with a solenoid excitation command from the control unit, and the control unit may output the solenoid excitation command for shifting the selector valve to the second position when the detection signal from the stick contraction-side pressure sensor is inputted to the control unit.

Figure 7:
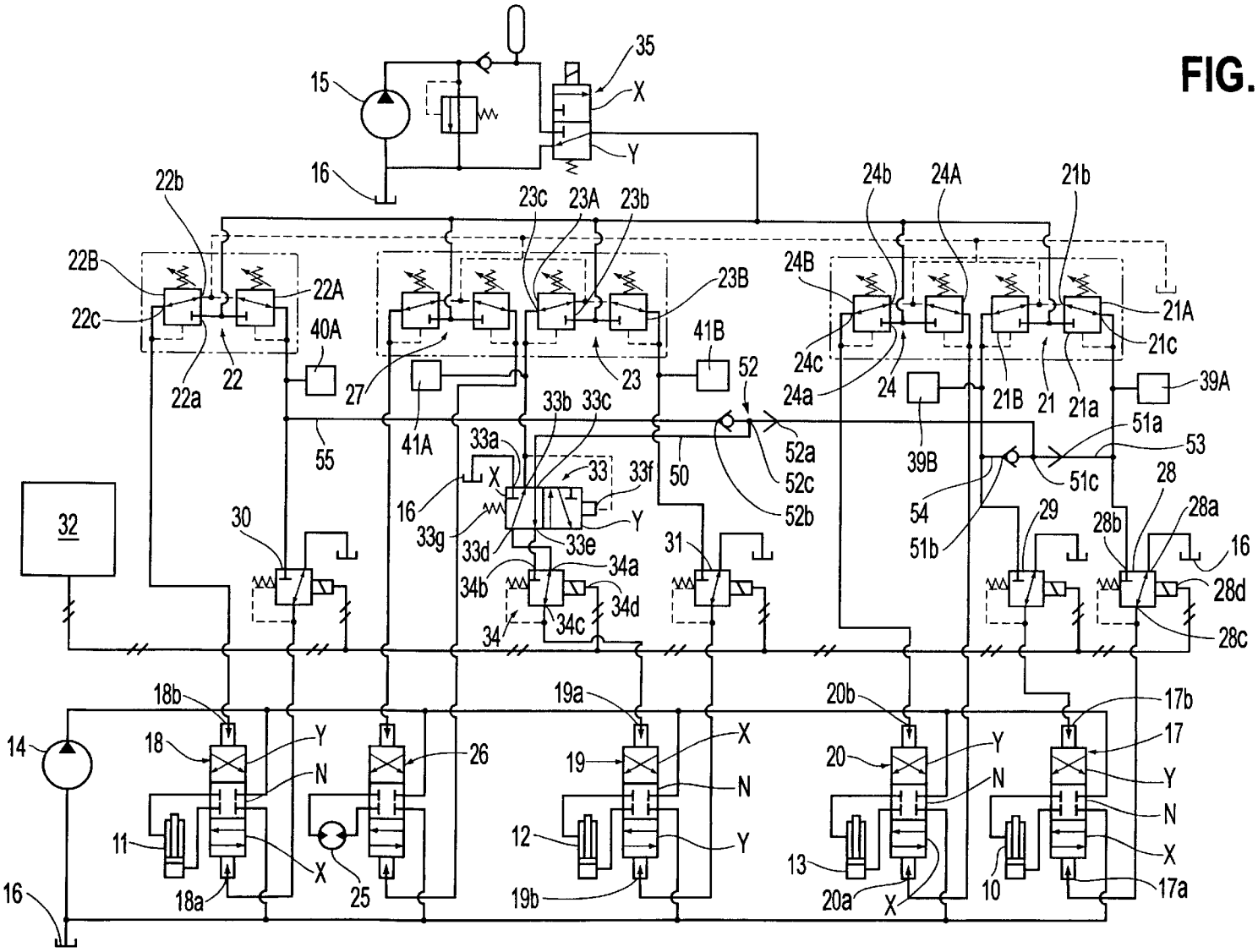
FIG. 7 is a hydraulic control circuit diagram for a hydraulic actuator according to a second embodiment.

Next, FIG. 7 shows a hydraulic control circuit diagram according to a second embodiment. In the second embodiment, the same reference numerals denote the same components as in the first embodiment and a detailed description thereof is omitted here. Components denoted by different reference line numerals and oil lines related to them will be described in detail. In the second embodiment a stick cylinder 12 corresponds to the first hydraulic actuator of the invention and a boom cylinder 10 and an offset cylinder correspond to the second hydraulic actuator of the invention.

First, a third port 33*c* of a selector valve 33 provided in a stick contraction-side pilot oil line is connected to an avoidance pilot oil line 50 described later. Then, in a state where the pilot pressurized oil is not supplied to a pilot port 33*f*, the selector valve 33 is in a first position X at which a first port 33*a* is closed by an urging force of a spring 33*g*, a valve passage extending from the third port 33*c* to a fifth port 33*e* is opened, and a valve passage extending from a fourth port 33*d* to a second port 33*b* is opened. Therefore, the pilot pressurized oil from the avoidance pilot oil line 50 can be supplied to a solenoid proportional pressure-reducing-valve second port 34*b*, and the oil from a solenoid proportional pressure-reducing-valve first port 34*a* can be drained to an oil tank 16 through a pilot valve 23A. As with the first embodiment, when the pilot pressurized oil is supplied to the pilot port 33*f*, the selector valve 33 is shifted to a second position Y at which the third port 33*c* is closed, a valve passage extending from the second port 33*b* to the fifth port 33*e* is opened, and a valve passage extending from the fourth port 33*d* to the first port 33*a* is opened. Therefore, the pilot pressurized oil from a pilot valve output port 23*c* can be supplied to the solenoid proportional pressure-reducing-valve second port 34*b*, and the oil from the solenoid proportional pressure-reducing-valve first port 34*a* can be drained to the oil tank 16.

Also, as with the first embodiment, in a state where a solenoid 34*d* is not excited, the solenoid proportional pressure reducing valve 34 provided on the stick contraction side opens a valve passage communicating the first port 34*a* and the third port 34*c*, and closes the second port 34*b*, thereby draining the oil from the contractionside pilot port 19*a* to the oil tank 16. When the solenoid 34*d* is excited in accordance with an operating command from a control unit 32, an output valve passage communicating the second port 34*b* and the third port 34*c* is opened. Upon the above output valve passage being opened, the pilot pressurized oil from the avoidance pilot oil line 50 having passed the selector valve 33 in the first position X or the pilot pressurized oil from the pilot valve 23A having passed the selector valve 33 in the second position Y is delivered to a control valve contraction-side pilot port 19*a*.

Here, the avoidance pilot oil line 50 is structured such that the pilot pressurized oil delivered from pilot valves 21A, 21B on the boom contraction and extension sides and a pilot valve 22A on the offset contraction side is supplied to the selector valve 33 through first and second shuttle valves 51, 52.

More specifically, a boom contraction-side pilot branch oil line 53 is branched from midway in an oil line connecting the boom contraction-side pilot valve 21A and a solenoid proportional pressure reducing valve 28 on the boom contraction side. Also, a boom extension-side pilot branch oil line 54 is branched from midway in an oil line connecting the boom extension-side pilot valve 21B and a solenoid proportional pressure reducing valve 29 on the boom extension side. Further, an offset contraction-side pilot branch oil line 55 is branched from midway in an oil line connecting the offset contraction-side pilot valve 22A and a solenoid proportional pressure reducing valve 30 on the offset contraction side.

The boom contraction- and extension-side pilot branch oil lines 53, 54 are connected respectively to inlet-side first and second ports 51*a*, 51*b* of the first shuttle valve 51, whereas an inlet-side first port 52*a* of the second shuttle valve 52 is connected to an outlet-side port 51*c* of the first shuttle valve 51. Further, the offset contraction-side pilot branch oil line 55 is connected to an inlet-side second port 52*b* of the second shuttle valve 52, and an outlet-side port 52*c* of the second shuttle valve 52 is connected to the avoidance pilot oil line 50. Accordingly, when the pilot pressurized oil is delivered from the boom contraction- or extension-side pilot valve 21A, 21B, the delivered pilot pressurized oil is supplied to the avoidance pilot oil line 50 via the boom contraction- or extension-side pilot branch oil line 53, 54, the first shuttle valve 51, and the second shuttle valve 52. Also, when the pilot pressurized oil is delivered from the offset contraction-side pilot valve 22A, the delivered pilot pressurized oil is supplied to the avoidance pilot oil line 50 via the offset contraction-side pilot branch oil line 55 and the second shuttle valve 52. Incidentally, when the pilot pressurized oil is delivered from either of the boom contraction- or extension-side pilot valves 21A, 21B and the offset contraction-side pilot valve 22A, the pilot pressurized oil on the higher pressure side is supplied to the avoidance pilot oil line 50.

Furthermore, numeral 35 denotes a locking solenoid valve which is disposed on the primary (upstream) side of the pilot valves 21-24, 27. Upon a lock control member (not shown) being manipulated by an operator, the locking solenoid valve 35 is shifted between an unlock position X at which the pilot pressurized oil from the pilot pump 15 is delivered to the pilot valves 21–14, 27, and a lock position Y at which the pilot pressurized oil is not delivered.

On the other hand, an output signal computing module 44, provided similarly to the first embodiment, outputs command signals to solenoid excitation circuits of the solenoid proportional pressure reducing valves 28, 29, 30, 34, 31 on the boom contraction side, the boom extension side, the offset contraction side, the stick contraction side, and the stick extension side based on input signals from a comparison operation module 43 and pressure sensors 39A, 39B, 40A, 41A, 41B.

More specifically, when the comparison operation module 43 provides such an operation result that the working implement 5 is away from the interference prevention area H by a distance not smaller than a certain range set in advance, the output signal computing module 44 outputs solenoid excitation commands to the solenoid proportional pressure reducing valves 28, 29, 30, 34, 31 in pilot oil lines where delivery of the pilot pressurized oil is detected by the pressure sensors 39A, 39B, 40A, 41A, 41B, causing the output valve passages to be fully opened.

Therefore, when the pilot pressurized oil is delivered from the pilot valves 21A, 21B, 22A, 23B on the boom contraction side, the boom extension side, the offset contraction side, and the stick extension side upon manipulations of the control members, the delivered pilot pressurized oil is supplied as it is to control valve pilot ports 17*a*, 17*b*, 18*a*, 19*b* via the solenoid proportional pressure reducing valves 28, 29, 30, 31 which are fully opened.

Also, while the selector valve 33 is provided in the stick contraction-side pilot oil line, the selector valve 33 is shifted to the second position Y for supplying the pilot pressurized oil from the pilot valve 23A to the solenoid proportional pressure reducing valve 34, as described above, in the state where the pilot pressurized oil is delivered from the stick contraction-side pilot valve 23A upon manipulation of the control member. Therefore, when the pilot pressurized oil is delivered from the stick contraction-side pilot valve 23A upon manipulation of the control member, the delivered pilot pressurized oil is supplied to the control valve pilot port 19*a* via the selector valve 33 in the second position Y and the solenoid proportional pressure reducing valve 33 which is fully opened.

Thus, when the working implement 5 is away from the interference prevention area H by a predetermined distance or more, the working implement 5 is operated as per the manipulation of the control member.

On the contrary, when the comparison operation module 43 provides such an operation result that the working implement 5 comes into the certain range set in advance with respect to the interference prevention area H, the output signal computing module 44 outputs solenoid excitation commands to the solenoid proportional pressure reducing valves 28, 29, 30, 34, 31 in the pilot oil lines where delivery of the pilot pressurized oil is detected by the pressure sensors 39A, 39B, 40A, 41A, 41B, causing the output valve passages to be opened at adjusted opening degrees. In this case, the opening degrees of the output valve passages of the solenoid proportional pressure reducing valves 28, 29, 30, 34, 31 are adjusted so that the output pressures of the solenoid proportional pressure reducing valves 28, 29, 30, 34, 31 become smaller as the working implement 5 comes closer to the interference prevention area H.

Therefore, when the pilot pressurized oil is delivered from the pilot valves 21A, 21B, 22A, 23A, 23B on the boom contraction side, the boom extension side, the offset contraction side, the stick contraction side, and the stick extension side upon manipulation of the control members, the delivered pilot pressurized oil is supplied to the control valve pilot ports 17*a*, 17*b*, 18*a*, 19*a*, 19*b* while being reduced in pressure by the solenoid proportional pressure reducing valves 28, 29, 30, 34, 31.

Thus, when the working implement 5 approaches the interference prevention area H within the predetermined distance, the operations of boom-down, boom-up, stick-out, stick-in, and leftward offset are performed at slowed down speeds.

Then, when the comparison operation module 43 provides such an operation result that the working implement 5 has reached an outer boundary line of the interference prevention area H, the output signal computing module 44 outputs control commands to the solenoid proportional pressure reducing valves 28, 29, 30, 31, 34 based on the command control table shown in FIG. 5. In this embodiment, two areas, i.e., an interference prevention area for a cab front/side portion (a front portion and a right side portion of the cab) and an interference prevention area for a cab roof portion, are each set as the interference prevention area H. In these areas, the control is executed separately.

FIG. 5 shows the relationship between the states of control member manipulation and operating commands issued to the working implement 5. In this respect, the states of control member manipulation for the boom-down, boom-up, stick-out, stick-in, and leftward-offset operations are determined in accordance with inputting of the detection signals from the pressure sensors 39A, 39B, 41A, 41B, 40A on the boom contraction side, the boom extension side, the stick contraction side, the stick extension side, and the offset contraction side.

As to the operating commands for the boom-down, boom-up, stick-out, and leftward-offset operations, solenoid excitation commands are outputted to the solenoid proportional pressure reducing valves 28, 29, 34, 30 on the boom contraction side, the boom extension side, the stick contraction side, and the offset contraction side, causing the output valve passages to be opened. Further, as to the operating commands to stop the boom-down, boom-up, stick-in, stick-out, and leftward-offset operations, solenoid non-excitation commands are outputted to the solenoid proportional pressure reducing valves 28, 29, 31, 34, 30 on the boom contraction side, the boom extension side, the stick extension side, the stick contraction side, and the offset contraction side, causing the output valve passages to be closed.

Here, the operating commands for the boom-down, boom-up, and leftward-offset operations are outputted in states where the boom-down, boom-up, and leftward-offset manipulations are performed. Accordingly, when the output valve passages of the solenoid proportional pressure reducing valves 28, 29, 30 are opened, the pilot pressurized oil delivered from the pilot valves 21A, 21B, 22A is supplied to the control valve pilot ports 17*a*, 17*b*, 18*a*.

As described later, the operating command for the stick-out operation is outputted not only in the case where the stick-out manipulation is performed, but also in the case where the stick-out manipulation is not performed. When the stick-out manipulation is performed, namely when the pilot pressurized oil is delivered from the stick contraction-side pilot valve 23A, the selector valve 33 is, as described above, in the second position Y at which the pilot pressurized oil from the pilot valve 23A is supplied to the solenoid proportional pressure reducing valve 34. Accordingly, the pilot pressurized oil from the stick contraction-side pilot valve 23A is supplied to the stick control valve contraction-side pilot port 19*a* via the selector valve 33 in the second position Y and the output valve passage of the solenoid proportional pressure reducing valve 34.

On the other hand, when the operating command for the stick-out operation is outputted in a state where the stick-out manipulation is not performed, the boom-down, boom-up, and leftward-offset manipulations are performed solely or in a combined manner, and the pilot pressurized oil delivered from any of the pilot valves 21A, 21B, 22A on the boom contraction side, the boom extension side, and the offset contraction side is supplied to the avoidance pilot oil line 50, as described later. At this time, since the pilot pressurized oil is not delivered from the stick contraction-side pilot valve 23A, the selector valve 33 is in the first position X where the pressurized oil in the avoidance pilot oil line 50 is supplied to the solenoid proportional pressure reducing valve 34. Accordingly, the pilot pressurized oil delivered from any of the pilot valves 21A, 21B, 22A on the boom contraction side, the boom extension side, and the offset contraction side is supplied to the stick control valve contraction-side pilot port 19*a* via the selector valve 33 in the first position X and the output valve passage of the solenoid proportional pressure reducing valve 34.

A description will be first made of the control to be executed when the working implement 5 has reached the outer boundary line of the interference prevention area H given by the front/side-portion interference prevention area. When solely the boom-down manipulation is performed, the operating commands for the boom-down and stick-out operations are outputted. As a result, the boom-down operation can be continued while the stick 8 is moved out so as to avoid the working implement 5 from entering the interference prevention area H. In this case, the working implement 5 is moved down substantially along the outer boundary line of the interference prevention area H.

When solely the stick-in manipulation is performed, the operating command to stop the stick-in operation is outputted. Also, when only the leftward-offset manipulation is performed, the operating command to stop the leftward offset operation is outputted. As a result, the working implement 5 is automatically stopped and prevented from entering the interference prevention area H.

When the boom-down and stick-in manipulations are performed in a combined manner, the operating commands for the boom-down and stick-out manipulations are outputted. Also, when the boom-down and leftward-offset manipulations are performed in a combined manner, the operating commands for the boom-down, stick-out and leftward-offset operations are outputted. Further, when the stick-in and leftward-offset manipulations are performed in a combined manner, the operating commands for the stick-out and leftward-offset operations are outputted. Moreover, when the boom-down, stick-in and leftward-offset manipulations are performed in a combined manner, the operating commands for the boom-down, stick-out and leftward-offset operations are outputted. As a result, the boom-down and leftward-offset operations can be continued while the stick 8 is moved out so as to prevent the working implement 5 from entering the interference prevention area H. In this case, the working implement 5 is moved substantially along the outer boundary line of the interference prevention area H.

When only the boom-up manipulation is performed, the operating commands for the boom-up and stick-out operations are outputted. As a result, the boom-up operation can be continued while the stick 8 is moved out so as to avoid the working implement 5 from entering the interference prevention area H. In this case, the working implement 5 is moved substantially along the outer boundary line of the interference prevention area H.

When the boom-up and stick-in manipulations are performed in a combined manner, the operating commands for the boom-up and stick-out operations are outputted. Also, when the boom-up and leftward-offset manipulations are performed in a combined manner, the operating commands for the boom-up, stick-out and leftward-offset operations are outputted. Further, when the boom-up, stick-in and leftward-offset manipulations are performed in a combined manner, the operating commands for the boom-up, stick-out and leftward-offset operations are outputted. As a result, the boom-up and leftward-offset operations can be continued while the stick 8 is moved out so as to prevent the working implement 5 from entering the interference prevention area H. In this case, the working implement 5 is moved substantially along the outer boundary line of the interference prevention area H.

In the control with respect to the front/side-portion interference prevention area, although not shown in FIG. 5, when the stick-out manipulation is performed solely or in combination with any of the above-mentioned manipulations (it is a matter of course that the stick-out manipulation and the stick-in manipulation are never performed at the same time), the operating command for the stick-out operation is outputted solely or in combination with any of the above-mentioned operating commands.

Next, a description will be made of the control to be executed when the working implement 5 has reached the outer boundary line of the interference prevention area H given by the roof-portion interference prevention area. When solely the boom-down manipulation is performed, the operating command to stop the boom-down operation is outputted. When only the stick-in manipulation is performed, the operating command to stop the stick-in operation is outputted. When only the stick-out manipulation is performed, the operating command to stop the stick-out operation is outputted. As a result, the working implement 5 is automatically stopped and prevented from entering the interference prevention area H.

As to the operating command outputted when only the boom-down manipulation is performed, the setting may be changed such that the operating commands for the boom-down and stick-out operations are outputted on condition that the angle of the stick 8 is an angle of elevation, as with when the boom-down and stick-in manipulations are performed in a combined manner as described later. In such a case, the boom-down operation can be continued while the stick 8 is moved out so as to avoid the working implement 5 from entering the interference prevention area H.

When the boom-down and stick-in manipulations are performed in a combined manner, the operating commands for the boom-down and stick-out operations or the operating commands to stop the boom-down and stick-in operations are outputted depending on the attitude of the stick 8. Specifically, when the angle of the stick 8 is an angle of elevation with respect to a vertical line L passing the pivotal fulcrum of the stick 8 as shown in FIG. 6(A), the operating commands for the boom-down and stick-out operations are outputted. As a result, the boom-down operation can be continued while the stick 8 is moved out so as to avoid the working implement 5 from entering the interference prevention area H.

In this case, the working implement 5 is moved substantially along the outer boundary line of the interference prevention area H. Also, when the angle of the stick 8 is an angle of declination with respect to the vertical line L passing the pivotal fulcrum of the stick 8 as shown in FIG. 6(B), the operating commands to stop the boom-down and stick-in operations are outputted. As a result, the working implement 5 is automatically stopped and is prevented from entering the interference prevention area H.

When the boom-down and stick-out manipulations are performed in a combined manner, the operating commands to stop the boom-down and stick-out operations are outputted. As a result, the working implement 5 is automatically stopped and is prevented from entering the interference prevention area H.

Furthermore, in the control with respect to the roof portion interference prevention area, although not shown in FIG. 5, when the boom-up manipulation is performed, the operating command for the boom-up operation is outputted, and when the leftward-offset manipulation is performed, the operating command for the leftward-offset operation is outputted. However, when the boom-up and leftward-offset manipulations are performed in combination with any of the above-mentioned manipulations (it is a matter of course that the boom-up manipulation and the boom-down manipulation are never performed at the same time), the operating commands for the boom-up and leftward-offset operations are outputted in combination with any of the above-mentioned operations.

Additionally, in the control with respect to any of the front/side-portion interference prevention area and the roof-portion interference prevention area, the operations of rightward offset and the bucket 9 are performed as per the manipulations of the control members because those operations are not subject to the interference prevention control as described above.

With the hydraulic control circuit thus structured, the working implement 5 is controlled as described above.

Specifically, when the working implement 5 is away from the interference prevention area H by the predetermined distance or more, the working implement 5 is operated as per the manipulation of the control member. However, when the working implement 5 approaches the interference prevention area H within the predetermined distance, the working implement 5 is automatically slowed down. Upon reaching the interference prevention area H, depending on the states of control member manipulation and the attitude of the working implement 5, the working implement 5 is automatically stopped, or the stick 8 is automatically moved out so that the up-and-down and leftward-offset operations of the working implement 5, i.e., the operation of a second actuator toward the interference prevention area, can be continued while precluding the working implement 5 from entering the interference prevention area H.

As a result, when the working implement 5 reaches the interference prevention area H during the boom-down manipulation, for example, the stick 8 is automatically moved out and the operation of moving the boom 6 down can be continued while avoiding the interference prevention area H. Thus, the operation is no longer suspended unlike the prior art and working efficiency is improved.

In addition, since the operation can be continued while avoiding the interference prevention area H just by automatically moving the stick 8 out, a circuit for automatically contracting a cylinder is required to be built in only the circuit for the stick cylinder 12 among the hydraulic actuators provided on the working implement 5. This contributes to simplifying the circuit and holding down any increase in cost. Further, as only the operation of moving the stick 8 out is automatically performed, the interference avoiding operation is simplified and the operator can easily recognize the operation under the control.

Moreover, the pilot pressurized oil supplied to the stick control valve contraction-side pilot port 19*a* for automatically moving the stick 8 out is the pilot pressurized oil delivered from any of the pilot valves 21A, 21B, 22A on the boom contraction side, the boom extension side, and the offset contraction side upon execution of the manipulation for the boom-down, boom-up or leftward-offset operations. Accordingly, an additional advantage is obtained in that even if the solenoid proportional pressure reducing valve 34 on the stick contraction side should malfunction due to a failure, or for any other reason, and the stick 8 should move out unintentionally, the unintentional moving-out of the stick 8 can be ceased by stopping the manipulations for the boom-down, boom-up and leftward-offset operations toward the interference prevention area.

In the above second embodiment, the selector valve 33 is constructed to shift from the first position X to the second position Y upon the pilot pressurized oil being supplied to the pilot port 33*f*. However, the selector valve 33 may comprise a solenoid valve shifting from a first position to a second position in accordance with a solenoid excitation command from the control unit, and the control unit may output the solenoid excitation command for shifting the selector valve to the second position when the detection signal from the stick contraction-side pressure sensor is inputted to the control unit.

Figure 8:
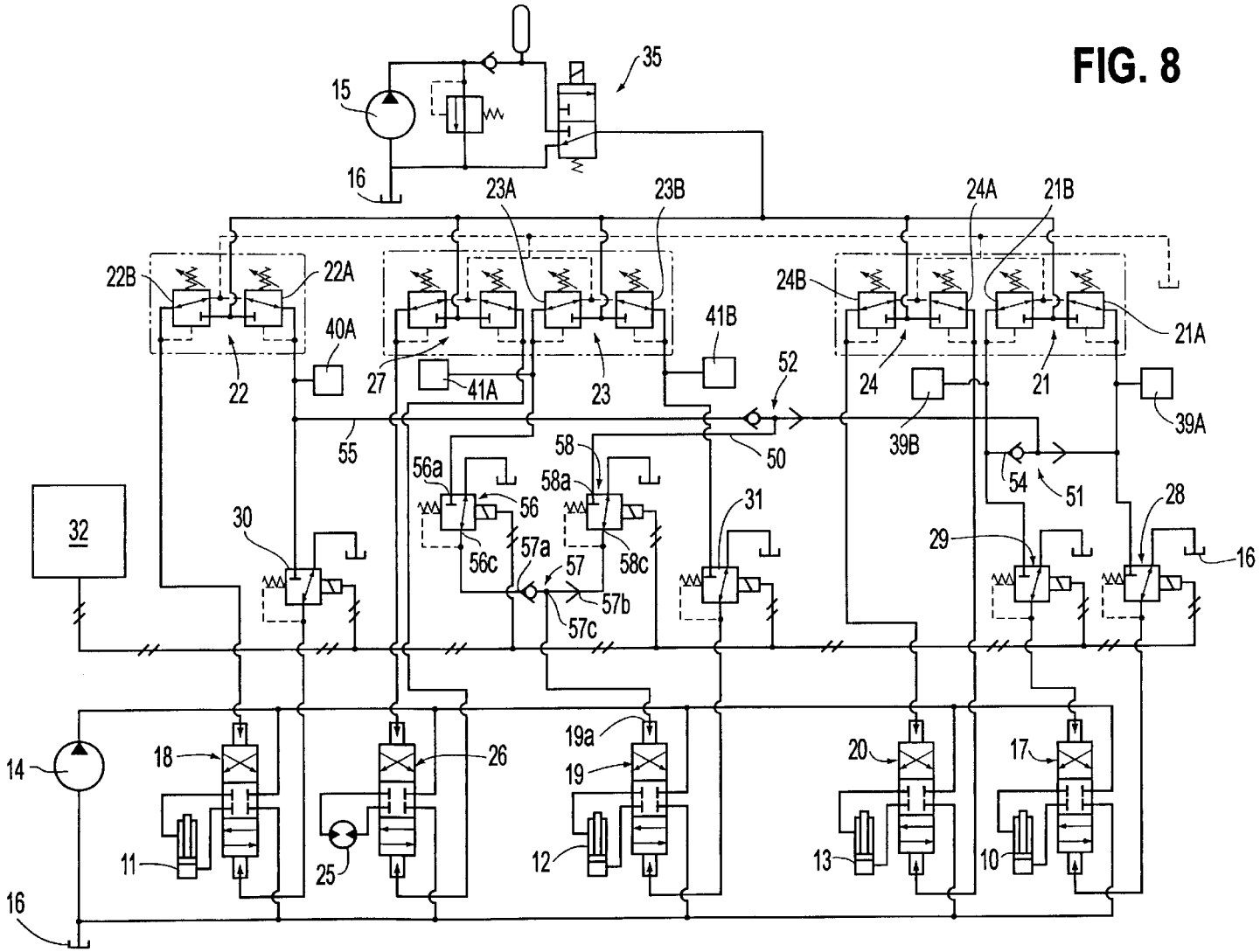
FIG. 8 is a hydraulic control circuit diagram for a hydraulic actuator according to a third embodiment.
Figure 9:
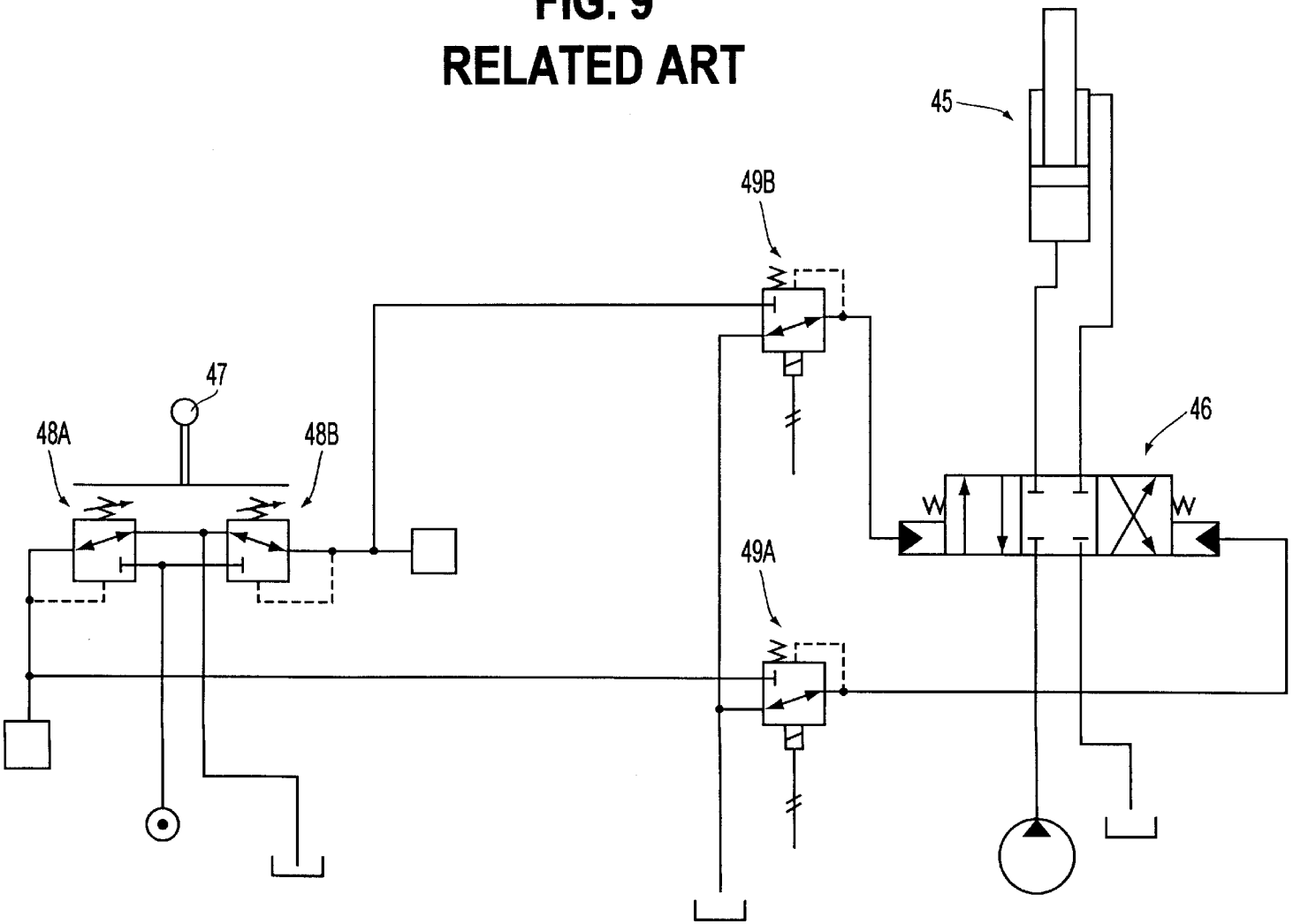
FIG. 9 RELATED ART
FIG. 9 is a hydraulic control circuit diagram for a related art hydraulic actuator.

For supplying the pilot pressurized oil in the avoidance pilot oil line 50 to the stick control valve contraction-side pilot port 19*a*, the hydraulic control circuit can also be structured in accordance with a third embodiment shown in FIG. 8. Note that the same leader-line numerals denote the same components as in the first and second embodiments and a detailed description thereof is omitted here.

In the third embodiment, a component corresponding to the selector valve 33 in the above first embodiment is not provided in a stick contraction-side oil line connecting a stick contraction-side pilot valve 23A and a stick control valve contraction-side pilot port 19*a*. A solenoid proportional pressure reducing valve 56 on the stick contraction side, which operates in accordance with a control command from a control unit 32, and a third shuttle valve 57 are provided in the stick contraction-side oil line instead.

The third shuttle valve 57 has an inlet-side first port 57*a* connected to a third port (output port) 56*c* of the solenoid proportional pressure reducing valve 56 on the stick contraction side, an inlet-side second port 57*b* connected to a third port (output port) 58*c* of an avoidance solenoid proportional pressure reducing valve 58 described later, and an outlet-side port 57*c* connected to the stick control valve contraction-side pilot port 19*a*. Of the pilot pressurized oil introduced from each of the inlet-side first and second ports 57*a*, 57*b*, the pilot pressurized oil on the higher pressure side is selected by the third shuttle valve 57 and then delivered from the outlet-side port 57*c* thereof.

The avoidance solenoid proportional pressure reducing valve 58 operates in accordance with a control command from the control unit 32, and has a first port (input port) 58*a* connected to the avoidance pilot oil line 50.

When the stick-out manipulation is performed, the control unit 32 outputs a control command to the solenoid proportional pressure reducing valve 56 on the stick contraction side, thereby fully opening an output valve passage connecting a first port (input port) 56*a* and the third port 56*c*, and also outputs a control command to the avoidance solenoid proportional pressure reducing valve 58, thereby fully closing an output valve passage connecting the first port 58*a* and the third port 58*c*. As a result, the third shuttle valve 57 selects the pilot pressurized oil from the solenoid proportional pressure reducing valve 56 on the stick contraction side, and the selected pilot pressurized oil is supplied to the stick control valve contraction-side pilot port 19*a*. Thus, when the stick-out manipulation is performed, the stick-out operation is carried out as per the manipulation.

On the other hand, when it is determined in a state of the stick-out manipulation not being performed that the working implement 5 has reached the outer boundary line of the interference prevention area H, the control unit 32 outputs a control command to the solenoid proportional pressure reducing valve 56 on the stick contraction side, thereby fully closing the output valve passage, and also outputs a control command to the avoidance solenoid proportional pressure reducing valve 58, thereby fully opening the output valve passage. As a result, the third shuttle valve 57 selects the pilot pressurized oil from the avoidance solenoid proportional pressure reducing valve 58, and the selected pilot pressurized oil is supplied to the stick control valve contraction-side pilot port 19*a*. Thus when the working implement 5 reaches the outer boundary line of the interference prevention area H in the state where the stick-out manipulation is not performed, the pilot pressurized oil from the avoidance pilot oil line 50 is supplied to the stick control valve contraction-side pilot port 19*a* via the avoidance solenoid proportional pressure reducing valve 58, causing the stick-out operation to be automatically carried out.

With the hydraulic control circuit described above, when a working implement enters an interference prevention area during operation, pilot pressurized oil is automatically supplied in the direction to move the working implement away from the interference prevention area, enabling the operation, or work, to be continued while avoiding the interference prevention area.

Also, the operation can be continued while avoiding the interference prevention area just by providing, in addition to a conventional circuit for stopping the working implement, a pilot pump oil line and a selector valve in an oil line for supplying the pilot pressurized oil in the direction to move a stick away from the interference prevention area. The invention contributes to simplifying the circuit and holding down any increase in cost.

What is claimed is:

1. A hydraulic control circuit for a working machine comprising a hydraulic actuator operated to move a working implement, and a pilot-operated directional control valve for controlling supply of pressurized oil to said hydraulic actuator, said hydraulic control circuit including:

a pressure control valve for controlling supply of pilot pressurized oil to said directional control valve in accordance with a command from a control unit;

a pilot valve for delivering the pilot pressurized oil to said pressure control valve in accordance with manipulation of a control member;

a pilot pump oil line capable of supplying the pilot pressurized oil to said pressure control valve from a pilot oil pressure source without passing said pilot valve; and a selector valve for supplying the pilot pressurized oil delivered from said pilot valve to said pressure control valve when said control member is manipulated, and supplying the pilot pressurized oil from said pilot pump oil line to said pressure control valve when said control member is not manipulated, said control unit including:

determining means for determining whether said working implement has entered a preset interference prevention area based on input signals from attitude detecting means for detecting an attitude of said working implement; and interference prevention control means for outputting a control command to said pressure control valve, causing the pilot pressurized oil to be supplied to said pilot-operated directional control valve in the direction to move said working implement away from the interference prevention area, when said determining means determines that said working implement has entered the preset interference prevention area.

2. The hydraulic control circuit for a working machine according to claim 1, wherein said hydraulic actuator for moving said working implement comprises a boom up-and-down moving cylinder for vertically swinging an offset type boom which is swingable in the up-and-down and left-and-right directions, a boom left-and-right moving cylinder for swinging said boom to the left and right, and a stick cylinder for swinging a stick back and forth which is supported to a fore end of said boom to be swingable in the back-and-forth direction; said pressure control valve, said pilot valve, said pilot pump oil line and said selector valve are provided in an oil line for supplying the pilot pressurized oil to the directional control valve for said stick cylinder in the direction to move said stick away from the interference prevention area; and said pressure control valve and said pilot valve are provided in each of oil lines for supplying the pilot pressurized oil to each of the directional control valves for said boom up-and-down moving cylinder, said boom left-and-right moving cylinder, and said stick cylinder in the direction to move said boom or said stick closer toward the interference prevention area.

3. A hydraulic control circuit for a working machine comprising first and second hydraulic actuators for operating a working implement, and first and second pilot-operated directional control valves for respectively controlling supply of pressurized oil to said hydraulic actuators, wherein said hydraulic control circuit includes:

interference prevention control means for preventing said working implement from entering an interference prevention area set in advance to prevent interference between a body of said working machine and said working implement, and said interference prevention control means includes a mechanism for operating said first hydraulic actuator in the direction away from the interference prevention area, thereby continuing operation of said second hydraulic actuator while said working implement is prevented from entering the interference prevention area when it is determined, at least in a state of said second hydraulic actuator being operated, that said working implement has reached the interference prevention area, said mechanism including valve means for switching over the circuit such that pilot pressurized oil for operating said second hydraulic actuator is also supplied to a pilot oil line for operating said first hydraulic actuator in the direction away from the interference prevention area.

4. The hydraulic control circuit for a working machine according to claim 3 wherein said hydraulic control circuit includes first and second approaching-side pilot oil lines for supplying the pilot pressurized oil respectively to said first and second directional control valves in the direction of moving said working implement to approach the interference prevention area, first and second away-side pilot oil lines for supplying the pilot pressurized oil respectively to said first and second directional control valves in the direction of moving said working implement away from the interference prevention area, and first and second approaching- and away-side pilot valves for outputting the pilot pressurized oil respectively to said first and second approaching- and away-side pilot oil lines in accordance with manipulation of first and second control members, and a pressure control valve for opening and closing the pilot oil line in accordance with a command from said interference prevention control means provided at least in said first approaching-side pilot line.

5. The hydraulic control circuit for a working machine according to claim 4, wherein when said second hydraulic actuator is provided in plural number, said second directional control valve, said second approaching- and away-side pilot oil lines, said second approaching- and away-side pilot valves are provided for each of the second hydraulic actuators, and the pilot pressurized oil delivered from said second approaching-side pilot valve is supplied to said valve means after being joined with other pilot pressurized oil through a shuttle valve for selecting the pilot pressurized oil on the higher pressure side.

6. The hydraulic control circuit for a working machine according to claim 4, wherein said valve means comprises a selector valve for switching over the circuit such that when the pilot pressurized oil is delivered from said first away-side pilot valve, the delivered pilot pressurized oil is supplied to said first away-side pilot oil line, and when the pilot pressurized oil is not delivered from said first away-side pilot valve, the pilot pressurized oil delivered from said second approaching-side pilot valve is supplied to said first away-side pilot oil line, and a pressure control valve for opening and closing said first away-side pilot oil line in accordance with a command from said interference prevention control means.

7. The hydraulic control circuit for a working machine according to claim 5, wherein said valve means comprises a selector valve for switching over the circuit such that when the pilot pressurized oil is delivered from said first away-side pilot valve, the delivered pilot pressurized oil is supplied to said first away-side pilot oil line, and when the pilot pressurized oil is not delivered from said first away-side pilot valve, the pilot pressurized oil delivered from said second approaching-side pilot valve is supplied to said first away-side pilot oil line, and a pressure control valve for opening and closing said first away-side pilot oil line in accordance with a command from said interference prevention control means.

8. The hydraulic control circuit for a working machine according to claim 4, wherein said valve means comprises a pressure control valve for outputting the pilot pressurized oil delivered from said second approaching-side pilot valve in accordance with a command from said interference prevention control means, and a shuttle valve for selecting one of the higher pressure side of the pilot pressurized oil delivered from said pressure control valve and the pilot pressurized oil delivered from said first away-side pilot valve and supplying the selected pilot pressurized oil to said first away-side pilot oil line.

9. The hydraulic control circuit for a working machine according to claim 5, wherein said valve means comprises a pressure control valve for outputting the pilot pressurized oil delivered from said second approaching-side pilot valve in accordance with a command from said interference prevention control means, and a shuttle valve for selecting one of the higher pressure side of the pilot pressurized oil delivered from said pressure control valve and the pilot pressurized oil delivered from said first away-side pilot valve and supplying the selected pilot pressurized oil to said first away-side pilot oil line.

10. The hydraulic control circuit for a working machine according to claim 3, wherein said working machine is a hydraulic shovel including, as said second hydraulic actuator, a boom up-and-down moving cylinder for vertically swinging an offset type boom which is swingable in the up-and-down and left-and-right directions, and an offset cylinder for swinging said boom to the left and right, and including, as said first hydraulic actuator, a stick cylinder for swinging a stick back and forth which is supported to a fore end of said boom to be swingable in the back-and-forth direction.

11. The hydraulic control circuit for a working machine according to claim 4, wherein said working machine is a hydraulic shovel including, as said second hydraulic actuator, a boom up-and-down moving cylinder for vertically swinging an offset type boom which is swingable in the up-and-down and left-and-right directions, and an offset cylinder for swinging said boom to the left and right, and including, as said first hydraulic actuator, a stick cylinder for swinging a stick back and forth which is supported to a fore end of said boom to be swingable in the back-and-forth direction.

12. The hydraulic control circuit for a working machine according to claim 5, wherein said working machine is a hydraulic shovel including, as said second hydraulic actuator, a boom up-and-down moving cylinder for vertically swinging an offset type boom which is swingable in the up-and-down and left-and-right directions, and an offset cylinder for swinging said boom to the left and right, and including, as said first hydraulic actuator, a stick cylinder for swinging a stick back and forth which is supported to a fore end of said boom to be swingable in the back-and-forth direction.

13. The hydraulic control circuit for a working machine according to claim 6, wherein said working machine is a hydraulic shovel including, as said second hydraulic actuator, a boom up-and-down moving cylinder for vertically swinging an offset type boom which is swingable in the up-and-down and left-and-right directions, and an offset cylinder for swinging said boom to the left and right, and including, as said first hydraulic actuator, a stick cylinder for swinging a stick back and forth which is supported to a fore end of said boom to be swingable in the back-and-forth direction.

14. The hydraulic control circuit for a working machine according to claim 7, wherein said working machine is a hydraulic shovel including, as said second hydraulic actuator, a boom up-and-down moving cylinder for vertically swinging an offset type boom which is swingable in the up-and-down and left-and-right directions, and an offset cylinder for swinging said boom to the left and right, and including, as said first hydraulic actuator, a stick cylinder for swinging a stick back and forth which is supported to a fore end of said boom to be swingable in the back-and-forth direction.

* * * * *